United States Patent [19]

Rimbey et al.

[11] Patent Number: 5,046,769

[45] Date of Patent: Sep. 10, 1991

[54] DOOR LATCH COUPLING ARRANGEMENT

[75] Inventors: Ronald P. Rimbey, Utica; Rita M. Paulik, Sterling Heights, both of Mich.

[73] Assignee: General Motors Corporation, Detroit, Mich.

[21] Appl. No.: 564,478

[22] Filed: Aug. 6, 1990

[51] Int. Cl.[5] ..... E05B 3/00

[52] U.S. Cl. ..... 292/216; 292/DIG. 27; 292/DIG. 65

[58] Field of Search ..... 292/DIG. 23, DIG. 65, 292/DIG. 27, 216, 65

[56] References Cited

U.S. PATENT DOCUMENTS

| | | | |
|---|---|---|---|
| 2,777,719 | 1/1957 | Jeavons | 292/DIG. 27 |
| 3,563,589 | 8/1968 | Kwasiborski, Jr. | 292/216 |
| 3,923,329 | 12/1975 | Torii et al. | 292/216 |
| 4,334,704 | 6/1982 | Yamada | 292/216 |
| 4,492,395 | 1/1985 | Yamada | 292/216 |
| 4,756,563 | 7/1988 | Garwood et al. | 292/216 |
| 4,969,673 | 11/1990 | Dortelli et al. | 292/DIG. 27 |

*Primary Examiner*—Gary L. Smith
*Assistant Examiner*—Darnell Boucher
*Attorney, Agent, or Firm*—Herbert Furman

[57] ABSTRACT

A door latch coupling arrangement includes a detent release member connected to an inside operator by a freewheeling connection. An intermittent member is movable between coupled and uncoupled positions with respect to the detent release member and pivotally connected to the inside operator to establish an operative connection between the detent release member and inside operator when in coupled position. A manual control member shifts the intermittent member between its coupled and uncoupled positions.

4 Claims, 3 Drawing Sheets

DOOR LATCH COUPLING ARRANGEMENT

This invention relates generally to vehicle door latches and more particularly to a vehicle door latch having a coupling arrangement for selectively coupling and uncoupling an inside operating means and the detent means of the door latch to prevent unauthorized unlatching of the door latch.

It is known to provide vehicle door latches with a coupling arrangement for selectively uncoupling an inside operator or handle from the door latch to prevent release of the door latch by an unauthorized person, such as a child passenger.

In the preferred embodiment of the invention, the coupling arrangement includes a freewheeling connection between the inside operator or handle and the detent release means, and an intermittent member which is coupled to the inside operator or handle and is shiftable by a manual control member between coupled and uncoupled positions with respect to the detent release means to selectively and alternately couple and uncouple the detent release means and the inside operator.

The detent release means includes a detent release lever which is pivotally mounted on the latch frame and releases the detent upon pivotal movement thereof. The detent release lever includes an arcuate slot receiving one end of a connector connecting the detent release lever and the inside operator. The slot and connector provide the freewheeling connection between the detent release lever and inside operator. The intermittent member includes a pair of slots respectively receiving the connector and the detent release lever pivot to thereby couple the connector and intermittent member and provide for shifting movement of the intermittent member between a coupled position with respect to the detent release lever, wherein the intermittent member is juxtaposed to an abutment of the detent release lever, and an uncoupled position relative to the detent release lever, wherein the intermittent member is out of juxtaposition to the detent release lever abutment. When the intermittent member is in coupled position and the inside operator is actuated, pivotal movement of the intermittent member by the inside operator rod engages the intermittent member with the detent release lever abutment to pivot the detent release lever and release the detent from the latch bolt to unlatch the vehicle door latch. When the intermittent member is in uncoupled position and the inside operator is actuated, the connector pivots the intermittent member about the detent release lever pivot rod. However, the intermittent member bypasses the detent release lever abutment so that the detent remains engaged with the latch bolt. The manual control member is a pivoted lever which shifts the intermittent member between coupled and uncoupled positions. The control lever mounts a pin received in an arcuate slot of the intermittent member to shift the intermittent member between coupled and uncoupled positions and yet allow pivotal movement of the intermittent member relative to the control lever when the the inside operator is actuated. The control lever is detentable in either of two positions respectively representing the coupled and uncoupled positions of the intermittent member.

The primary feature of this invention is that it provides an improved coupling arrangement for selectively coupling and uncoupling a vehicle door latch operating means and detent means to prevent unauthorized unlatching of the door latch. Another feature is that the coupling arrangement includes a detent release means and an intermittent member selectively operable to couple and uncouple the detent release means and the latch operating means. A further feature is that the detent release means is connected to the latch operating means by a freewheeling connection and the intermittent member obviates the freewheeling connection and operatively connects the detent release means and latch operating means when the intermittent member is in coupled position. Yet another feature is that a manually operable control member is provided to move the intermittent member between coupled and uncoupled positions. Yet a further feature is that the detent release means includes a pivotally mounted detent release lever having a slotted connection to the latch operating means, and the intermittent member is mounted to the detent release lever and is juxtaposed to an abutment of the detent release lever and coupled to the latch operating means when in coupled position to furnish an operative connection between the detent release lever and latch operating means.

These and other features of the invention will be apparent from the following specification and drawings wherein.

Figure 1:
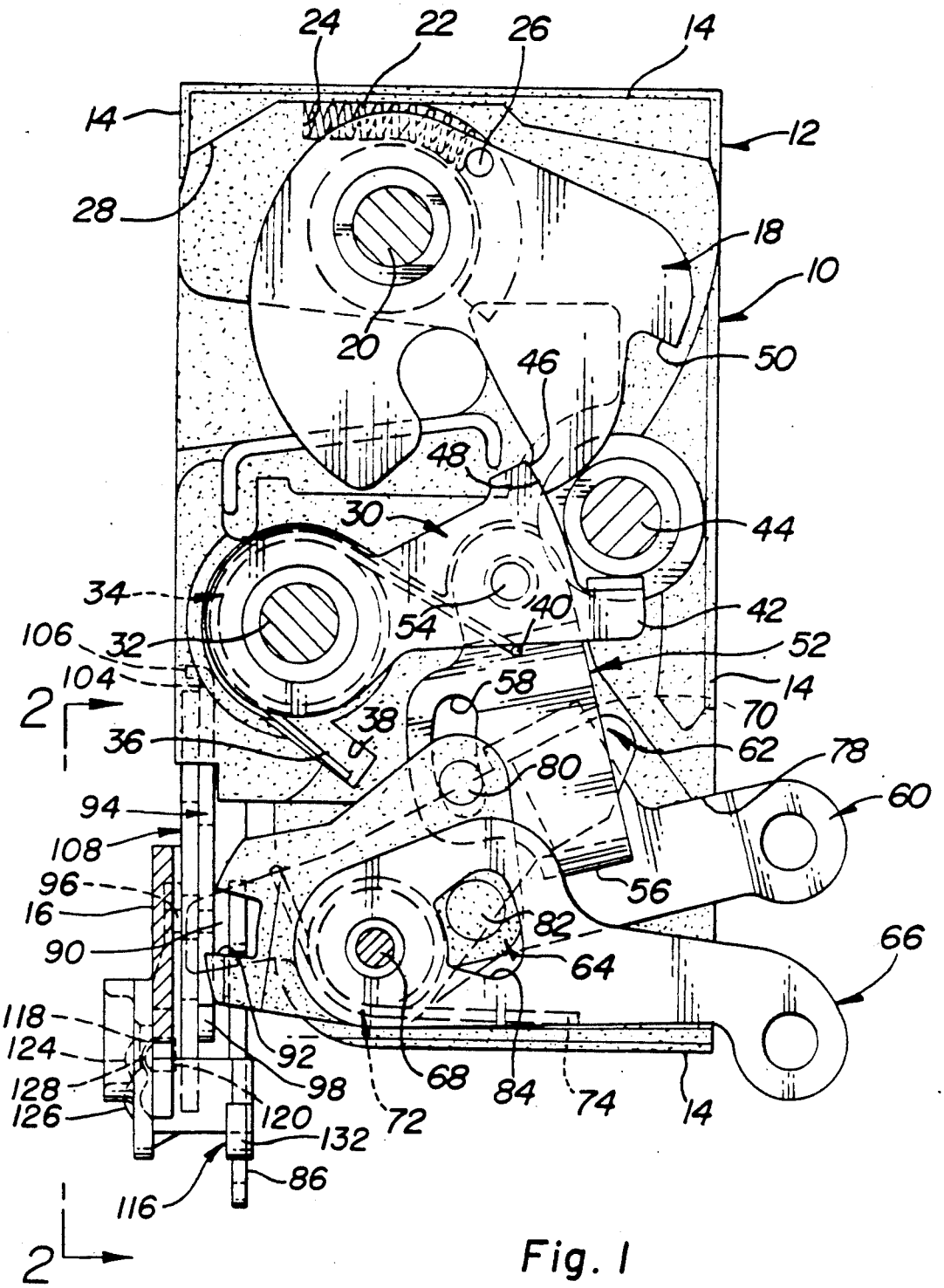
FIG. 1 is a partially broken away view of a vehicle door latch embodying a coupling arrangement according to this invention, with the latch being shown in unlocked condition and the latch bolt being shown in latched position.

Referring now to FIG. 1 of the drawings, the vehicle door latch 10 shown is substantially the same as that shown and described in U.S. Pat. No. 4,756,563 Garwood et al., Vehicle Door Latch, issued Jul. 12, 1988, and assigned to the assignee of this invention. Therefore, only a brief description necessary for an understanding of this invention will be given and reference may be had to the Garwood et al. patent for further details of the door latch 10.

The latch 10 includes a molded plastic housing member 12 which opens outwardly and has a series of peripheral wall portions 14 along the outer walls thereof. A cover, not shown, fits within the wall portions 14 and includes a lateral extension or side flange 16, shown in detail in FIGS. 2 through 4.

A fork type bolt 18 is pivoted on a bushing 20 which is mounted within the housing member 12. A coil compression spring 22 in a recess 24 of the housing member engages a pin 26 of the latch bolt to bias the bolt clockwise from its latched position shown, to an unlatched position, not shown, wherein the outer edge of the bolt engages a shoulder 28 of the housing member 12.

The bolt is held in latched position by a detent 30 which is pivoted on another bushing 32 mounted within the housing member 12. The detent is biased counterclockwise by a torsion spring 34 which surrounds the bushing 32 and has one leg 36 anchored in a recess 38 of the housing member and the other leg provided with a lateral terminal 40 which engages the lower edge of the detent. The engagement of a rubber bumpered leg 42 of the detent with another bushing 44 mounted within the housing member 12 locates the detent in detented position under the bias of the spring 34. In detented position, a detent shoulder 46 engages a primary latching shoulder 48 of the bolt 18 to retain the bolt in primary latched position. The detent shoulder 46 is also engageable with a secondary latching shoulder 50 of the latch bolt 18 to retain the bolt in secondary latched position.

An intermittent member 52 is pivoted at 54 to the detent 30 and includes a lower lateral tab 56 and an arcuate slot 58. An outside operating lever 60, a transfer lever 62, a locking lever 64, and a key cylinder lever 66 are all coaxially mounted on a shouldered stud 68 mounted within the housing member 12. A lateral tab 70 of the outside operating lever 60 engages the upper edge of the transfer lever 62 to pivotally couple the levers 60 and 62. A coil torsion spring 72 surrounds the stud 68 and has one leg 74 engaging the lower wall of the housing member 12 and the other leg hooked over the transfer lever 62 to bias the transfer lever 62 and the outside operating lever 60 counterclockwise about the stud 68 and engage the operating lever 60 with a shoulder 78 of the housing member 12. The outside operating lever 60 is conventionally connected to a manually operable outside operator, such as a pull type, paddle type, or push button type handle which rotates the levers 60 and 62 clockwise to operating position. The engagement of the lower edge of the transfer lever 62 with the lateral tab 56 of the intermittent member 52, when the intermittent member is in coupled position, as shown, moves the intermittent member downwardly and in turn rotates the detent 30 clockwise about the bushing 32 against the bias of spring 34 to undetented position, not shown, wherein the detent shoulder 46 is out of engagement with the latch bolt shoulder 48 to permit the latch bolt to move to unlatched position.

The locking lever 64 includes a pin 80 received in the arcuate slot 58 of the intermittent member 52 and a pin 82 received in an opening 84 of the key cylinder lever 66. The key cylinder lever 66 is conventionally connected to an outside key cylinder for clockwise movement of the lever 66 between its unlocked position shown, and a locked position, not shown, clockwise of its unlocked position. This movement of lever 66 engages the edge of opening 84 with pin 82 to move the locking lever 64 clockwise from its unlocked position as shown to a locked position wherein the pin 80 rotates the intermittent member 52 slightly counterclockwise to uncoupled position. In uncoupled position, the lateral tab 56 of the intermittent member 52 is located to the right of the transfer lever 62 to uncouple the transfer lever and outside operating lever 60 from the intermittent member 52.

An L-shaped inside locking lever 86 is pivoted at 88 to the inner side of the side flange 16 and includes a leg 90 which is received in a slot 92 of the locking lever 64, FIG. 1. An overcenter spring, not shown, is coupled between the lever 86 and the flange 16 to alternately locate the lever 86 in its unlocked position shown, or its locked position, not shown, counterclockwise of its unlocked position, wherein the lever 86 locates the locking lever 64 in its locked position, previously described. The inside locking lever 86 is conventionally coupled to an inside garnish button, lever, or other inside lock operator.

Figure 2:
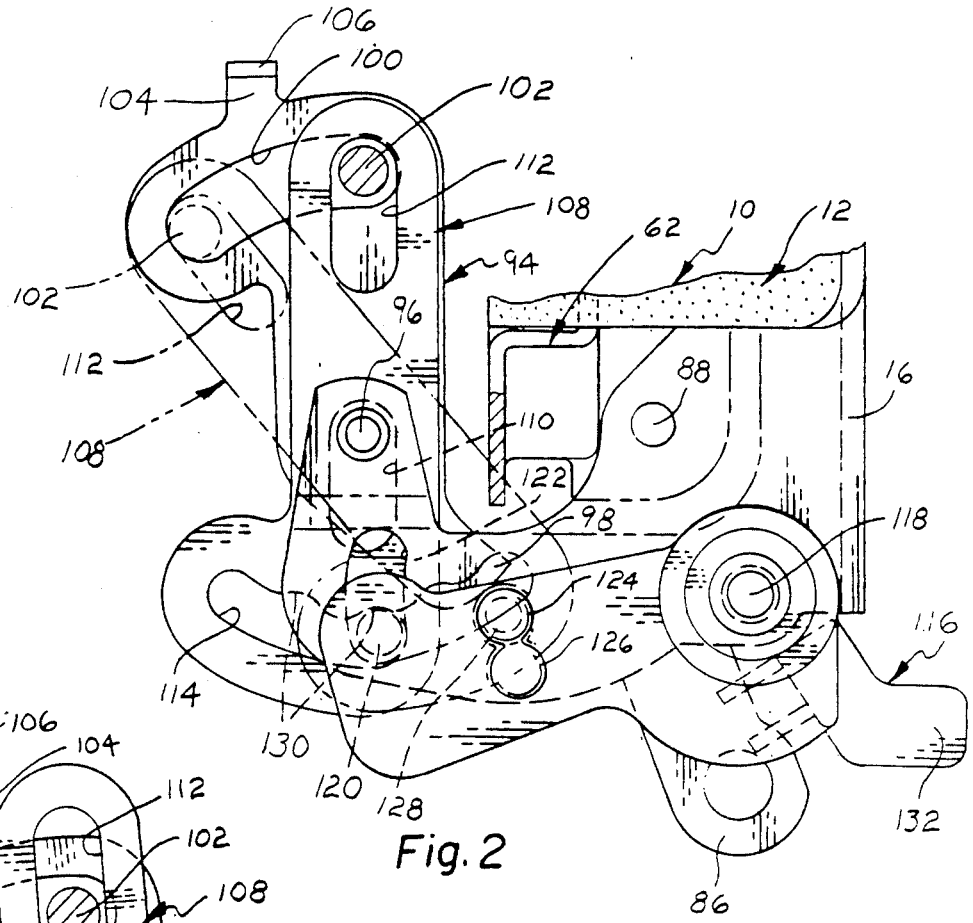
FIG. 2 is a view taken along line 2—2 of FIG. 1 showing the intermittent member in uncoupled position.
Figure 3:
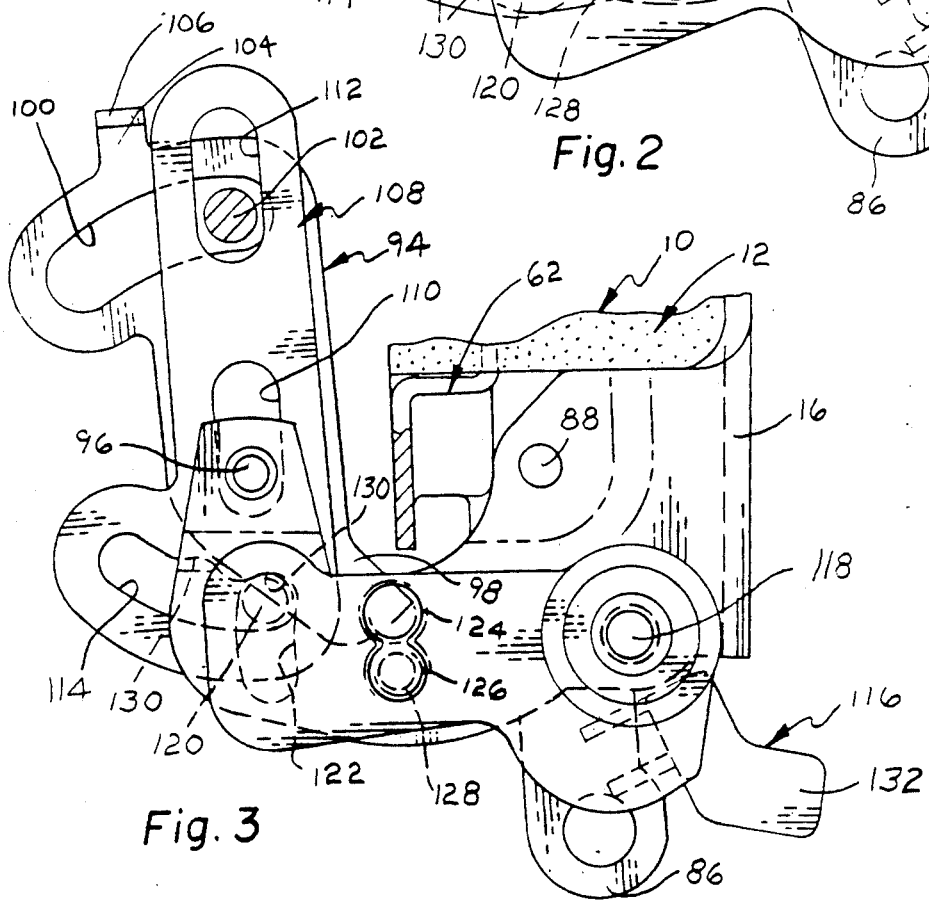
FIG. 3 is a view similar to FIG. 2 showing the intermittent member in coupled position.
Figure 4:
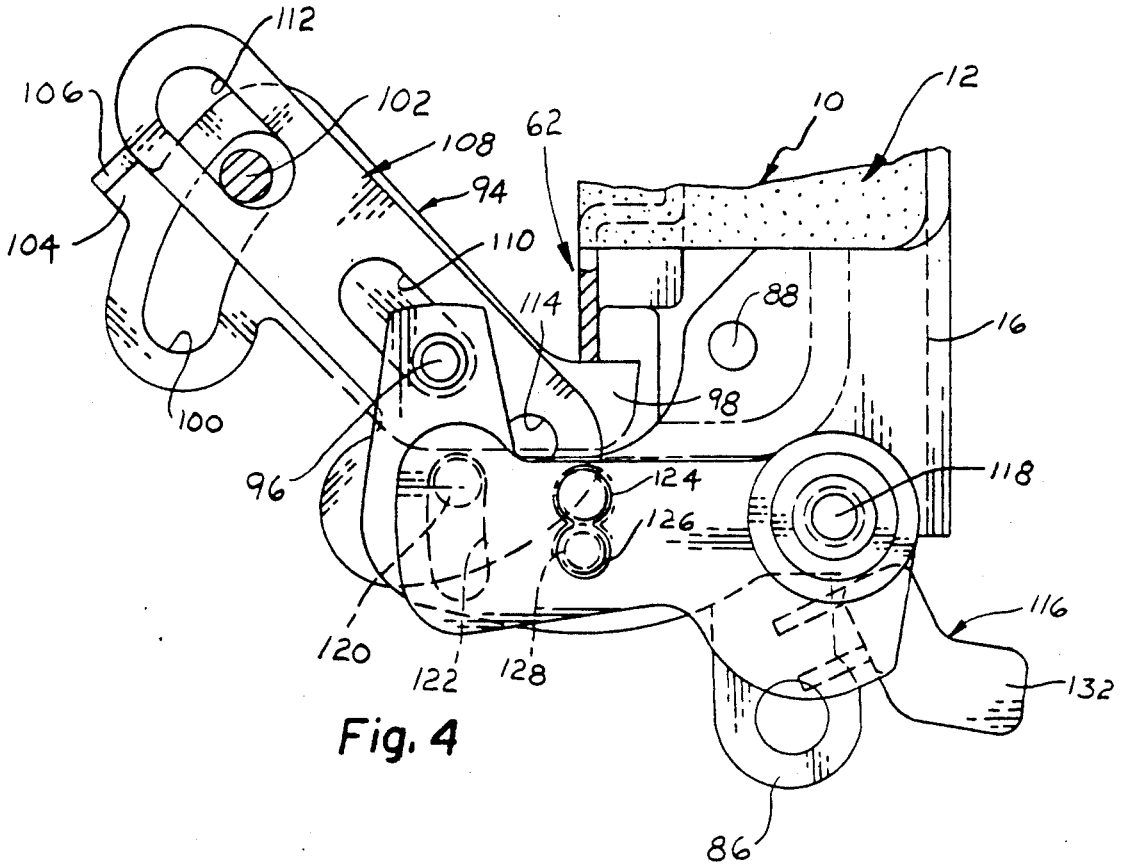
FIG. 4 is a view similar to FIG. 3 showing the detent release lever in operative position.

Referring now to FIGS. 2 through 4 of the drawings, a coupling arrangement according to this invention includes a detent release lever 94 which is pivoted at 96 to the side flange 16 of the cover of the door latch 10. The detent release lever 94 includes a foot 98 which underlies an end of the transfer lever 62 to operate the transfer lever and release the detent, when the intermittent member 52 is in coupled position, upon counterclockwise movement of the detent release lever 94. The detent release lever 94 includes an arcuate slot 100 which is generated about the pivot 96 and receives the lateral bent end of an inside operating rod or connector 102, the other end of which is connected to the inside operator, such as a pivoted inside door handle, not shown. The detent release lever 94 further includes an upwardly extending tab 104 having a lateral bent end 106 for a purpose to be described.

An intermittent or coupling member 108 overlies detent release lever 94 includes linear slots 110 and 112, slot 110 slidably receiving the pivot 96 and slot 112 slidably receiving the bent end 102 of the inside operating rod. The intermittent member 108 is movable, as will be described, between an uncoupled position shown in FIG. 2 and a coupled position shown in FIGS. 3 and 4 wherein the left-hand edge of the intermittent member is juxtaposed to the lateral end 106 of the detent release lever 94. The lower end of the intermittent member includes an arcuate slot 114, FIGS. 2 and 3, which is generated about the end of rod 102.

A control lever 116 is pivoted at 118 to the side flange 16 and mounts a pin 120 at its end which is received within the slot 114 and also within a vertical arcuate slot 122 of the flange 16 generated about pivot 118. The control lever 116 has a pair of adjacent outwardly embossed depressions or dimples 124 and 126 which selectively and alternately receive an outwardly embossed dimple 128 embossed outwardly of the side flange 16. When the dimple 128 is received within the depression 126 as shown in FIG. 3, the intermittent member 108 is located in its coupled position, being shifted upwardly from its uncoupled position shown in FIG. 2 by the engagement of pin 120 with one of a pair of slight depressions 130 in the upper edge of the slot 114. When the control lever 116 is in its FIG. 2 position, dimple 128 is received in dimple 124 and the engagement of pin 120 with the lower edge of slot 114 has shifted the intermittent member 108 downwardly from its FIG. 3 coupled position to its uncoupled position of FIG. 2. The control lever 116 has an extension 132 which extends outwardly of the rear wall of the vehicle door on which the latch 10 is mounted so as to be accessible by the driver or passenger when the door is in an open position but inaccessible when the door is closed. By manually grasping the extension 132, the control lever 116 can be moved between its FIG. 2 and its FIG. 3 positions to respectively locate the intermittent member in uncoupled and coupled positions.

When the intermittent member 108 is in uncoupled position shown in FIG. 2, operation of the inside handle to shift the rod 102 to the left will rotate the intermittent member 108 counterclockwise about pivot 96 from its full line position to its dash line position as the lateral bent end of rod 102 engages the left-hand edge of slot 112 and moves within the slot 100 and slot 114 moves relative to pin 120, with the intermittent member pivoting about the pivot 96 of the release lever 94. The lever 94 remains stationary.

When the intermittent member 108 is in the coupled position shown in FIG. 3, counterclockwise movement of the intermittent member by the operating rod 102 will engage the left-hand edge of the intermittent member with the end 106 of detent release lever 94 to pivot the detent release lever 94 with the intermittent member about the pivot 96 and engage the foot 98 of the release lever with the transfer lever to release the detent, as previously described. During this movement of the intermittent member and release lever as a unit, slot 114 again moves relative to pin 120. FIG. 4 shows the position of the release lever and intermittent member when the release lever has engaged and pivoted the transfer lever 62 to release the detent.

Thus, this invention provides an improved coupling improvement for a vehicle door latch.

The embodiments of the invention in which an exclusive property or privilege is claimed are defined as follows:

1. In a vehicle door latch having frame means, latch bolt means mounted on the frame means for movement between latched and unlatched positions, detent means mounted on the frame means for movement between detented and undetented positions with respect to the latch bolt means, and operating means for moving the detent means to undetented position, a coupling arrangement for selectively coupling and uncoupling the operating means and detent means comprising, in combination, a detent release lever pivotally mounted on the frame means, means operatively connecting the detent release lever and detent means for moving the detent means to undetented position upon pivotal movement of the detent release lever, means slidably coupling the detent release lever and the operating means whereby the operating means freewheels with respect to the detent release lever, an intermittent member, means mounting the intermittent member on the frame means for shifting movement of the intermittent member between coupled and uncoupled positions with respect to the detent release lever and pivotal movement of the intermittent member with respect to the frame means in each position, control means for moving the intermittent member between coupled and uncoupled positions, means coupling the intermittent member and the operating means during pivotal movement of the intermittent member in each position thereof and permitting shifting movement of the intermittent member relative to the operating means during movement of the intermittent member between coupled and uncoupled positions, and cooperating means on the detent release lever and intermittent member engageable with each other in the coupled position of the intermittent member for pivoting the detent release lever to release the detent means upon pivotal movement of the intermittent member by the operating means.

2. In a vehicle door latch having frame means, latch bolt means mounted on the frame means for movement between latched and unlatched positions, detent means mounted on the frame means for movement between detented and undetented positions with respect to the latch bolt means, and operating means for moving the detent means to undetented position, a coupling arrangement for selectively coupling and uncoupling the operating means and detent means comprising, in combination, a detent release lever pivotally mounted on the frame means, means operatively connecting the detent release lever and detent means for moving the detent means to undetented position upon pivotal movement of the detent release lever, a shiftable connector connected at one end thereof to the operating means, means slidably connecting the other end of the connector to the detent release lever whereby the connector freewheels with respect to the detent release lever when shifted by the operating means, an intermittent member mounted on the detent release lever for shifting movement relative thereto between coupled and uncoupled positions, means connecting the other end of the connector to the intermittent member in the coupled and uncoupled positions thereof, means for shifting the intermittent member between its coupled and uncoupled positions, and coacting abutment means on the detent release lever and intermittent member juxtaposed to each other in the coupled position of the intermittent member for establishing an operative connection between the connector and detent release lever to provide for movement of the detent means to undetented position upon actuation of the operating means.

3. In a vehicle door latch having frame means, latch bolt means mounted on the frame means for movement between latched and unlatched positions, detent means mounted on the frame means for movement between detented and undetented positions with respect to the latch bolt means, and operating means for moving the detent means to undetented position, a coupling arrangement for selectively coupling and uncoupling the operating means and detent means comprising, in combination, a detent release lever pivotally mounted on the frame means and including a slot, means operatively connecting the detent release lever and detent means for moving the detent means to undetented position upon pivotal movement of the detent release lever, a connector connected at one end thereof to the operating means, means on the other end of the connector received in the slot of the detent release lever to provide a freewheeling connection therebetween, an intermittent member having a pair of slots, one such slot extending transverse to the detent release lever slot and receiving the other end of the connector to establish an operative connective therebetween, the other such slot receiving the detent release lever pivot, the slots and their respective connector and pivot mounting the intermittent member on the detent release lever for shifting movement relative thereto between coupled and uncoupled positions, coacting means on the detent release lever and intermittent member providing a connection therebetween in the coupled position of the intermittent member, and means for shifting the intermittent member between its coupled and uncoupled positions.

4. In a vehicle door latch having frame means, latch bolt means mounted on the frame means for movement between latched and unlatched positions, detent means mounted on the frame means for movement between detented and undetented positions with respect to the latch bolt means, and operating means for moving the detent means to undetented position, a coupling arrangement for selectively coupling and uncoupling the operating means and detent means comprising, in combination, a detent release lever pivotally mounted on the frame means and including an arcuate slot, means operatively connecting the detent release lever and detent means for moving the detent means to undetented position upon pivotal movement of the detent release lever, a connector connected at one end thereof to the operating means, means on the other end of the connector received in the slot of the detent release lever to provide a freewheeling connection therebetween, an intermittent member having a pair of linear slots, one such linear slot extending transverse to the detent release lever slot and receiving the other end of the connector to establish an operative connective therebetween, the other such linear slot receiving the detent release lever pivot, the slots and their respective connector and pivot mounting the intermittent member on the detent release lever for shifting movement relative thereto between coupled and uncoupled positions, abutment means on the detent release lever, abutment means on the intermittent member juxtaposed to the detent release lever abutment means in the coupled position of the intermittent member for establishing a connection therebetween upon pivotal movement of the intermittent member by the connector to move the detent means to undetented position upon actuation of the connector by the operating means, and means for shifting the intermittent member between coupled and uncoupled positions.

* * * * *